US005662426A

United States Patent [19]

Strickland

[11] Patent Number: 5,662,426

[45] Date of Patent: Sep. 2, 1997

[54] DRIVE HUB AND SPINDLE ASSEMBLY FOR CYLINDRICAL BROOMS

[75] Inventor: Timothy A. Strickland, Raeford, N.C.

[73] Assignee: Windsor Industries, Inc., Englewood, Colo.

[21] Appl. No.: 534,443

[22] Filed: Sep. 27, 1995

[51] Int. Cl.[6] ..... F16B 21/02

[52] U.S. Cl. ..... 403/348; 403/24; 403/350; 15/82; 15/179

[58] Field of Search ..... 403/348, 349, 403/350, 345, 24, 359; 15/82, 179, 181, 182, 183

[56] References Cited

U.S. PATENT DOCUMENTS

| | | | |
|---|---|---|---|
| 3,078,488 | 2/1963 | Helm | 15/179 X |
| 3,600,735 | 8/1971 | Jorabek | 403/348 X |
| 3,846,861 | 11/1974 | Smith, Sr. | 15/179 |
| 4,391,548 | 7/1983 | Malish | 403/348 |
| 4,507,006 | 3/1985 | Golob et al. | 403/348 X |
| 4,662,024 | 5/1987 | Moench | 403/348 X |
| 4,730,952 | 3/1988 | Wiley | 403/349 X |
| 4,893,426 | 1/1990 | Bixler | 403/348 X |
| 5,261,758 | 11/1993 | Vranish | 403/348 |
| 5,386,608 | 2/1995 | Montabaur et al. | 15/179 |

FOREIGN PATENT DOCUMENTS

| | | | |
|---|---|---|---|
| 29020 | 12/1913 | United Kingdom | 15/181 |

OTHER PUBLICATIONS

"Here's The News You've Been Waiting For", advertisement by Flo–Pac, one page (No Date Available).

"Replacement Brushes to Fit Tennant Power Sweepers", by Flo–Pac, three pages (No Date Available).

AAR PowerBoss® Badger ™TSS/62E manual, p. 48, dated Apr. 1992.

*Primary Examiner*—Harry C. Kim

*Attorney, Agent, or Firm*—Sheridan Ross P.C.

[57] ABSTRACT

A drive hub spindle assembly for use in connection with a cylindrical broom (12) is provided which enhances power transmission and facilitates drive hub/spindle engagement. The drive hub (10) includes three radially projecting lugs (24) for engaging mating recesses (72) of the spindle (60). A novel reinforcing structure (52) associated with each of the lugs (24) is also disclosed. The hub (10) is self-centering and requires minimal manipulation during engagement.

13 Claims, 8 Drawing Sheets

DRIVE HUB AND SPINDLE ASSEMBLY FOR CYLINDRICAL BROOMS

FIELD OF THE INVENTION

This invention relates generally to industrial sweepers and, in particular, to an improved drive hub and spindle assembly for transmitting power from a drive shaft to a cylindrical broom of an industrial sweeper.

BACKGROUND OF THE INVENTION

Industrial sweepers are typically motor driven vehicles that employ a rotating broom to lift debris from a surface such as a floor. Such sweepers commonly rely upon a cylindrical broom, which rotates about an axis which is parallel to the floor surface, to lift debris that is then deposited in a hopper. The cylindrical broom is typically located beneath the sweeper body and is rotated so that the brushes of the broom move against the floor surface. Some sweepers also include an additional cylindrical broom or brooms which project outwardly from the sweeper and sweep debris into the path of the sweeper thereby broadening the sweeping path.

Such cylindrical brooms are normally mounted on a drive shaft for rotationally driving the broom. In this regard, the cylindrical broom is formed as a hollow cylindrical body with broom brushes mounted on the outer surface. The drive shaft is received within the cylindrical body and power is transmitted from the drive shaft to the broom by hubs mounted on the ends of the cylindrical body that interconnect to a mating spindle mounted to the shaft, thereby linking the shaft and broom.

In operation, the drive hubs are subject to considerable radial and torsional loads. These loads are due to, among other things, the substantial weight of the broom, downward pressure exerted on the broom for improved sweeping, and frictional forces incident to rotation of the broom against the floor surface, together with angular accelerations due to starts and stops of the broom.

In addition to bearing such loads, the drive hubs are disengaged from and then re-engaged to the drive shaft spindle during broom changing or replacement. In intense industrial use, the brooms need to be replaced periodically due to brush wear. The brooms may also be changed to address different sweeping conditions. For example, different brush materials and patterns may be desired depending on the type of debris and surface to be swept.

Therefore, the drive hubs must be strong enough to withstand the substantial radial and axial loads experienced in operation. Additionally, it is desirable for the drive hubs to be designed in conjunction with the spindles for simple broom changing or replacement. Moreover, the drive hubs should preferably be lightweight for improved efficiency and are preferably of simple construction and inexpensive to produce.

Currently, most if not all drive hubs are constructed as a plastic annulus which engages the broom body at an outer surface and engages the drive shaft spindle at an inner surface. The drive hub is keyed to the drive shaft spindle by way of two lugs which project inwardly from the inner surface of the drive hub into mating recesses of the spindle at diametrically opposed locations. The annular body normally includes an inner wall and an outer wall connected by spaced radial ribs.

In one conventional drive hub, a narrow rib extends outwardly from a center of each of the hollow lugs to the outer wall. Another conventional drive hub includes three ribs of equal axial depth spaced across the width of each of the hollow lugs. Yet another conventional drive hub includes a reinforcing mass, extending lengthwise from each of the solid lugs to the outer wall, having a circumferential width and axial depth approximately as great as those of the lug. The reinforcing mass is interrupted by four axially oriented cylindrical holes or cavities extending nearly through the depth of the mass.

SUMMARY OF THE INVENTION

The present invention is directed to a drive hub and spindle assembly which allows for increased torque transmission and simplified hub/spindle engagement. In the latter regard, the drive hub of the present invention is self-centering relative to the spindle and allows for reduced rotation in achieving proper hub/spindle alignment. That is, the drive hub and spindle design minimizes axial and circumferential manipulation with respect to coupling the drive hub to the spindle during broom changing or replacement. The design also reduces or substantially eliminates hub warpage resulting in enhanced performance and reduced wear.

It has been recognized that conventional drive hubs which employ two diametrically opposed hubs are subject to certain limitations. One limitation of such conventional drive hubs relates to power transmission. The maximum drive torque which can be exerted via such conventional drive hubs is limited by the maximum shear forces which can be borne by the two opposing lugs. This, in turn, limits the maximum drive force which can be applied to the broom.

Additionally, it is difficult to properly engage such conventional drive hubs to the drive shaft spindle during broom changing or replacement. For proper engagement, the drive hub must be centered relative to the spindle and the lugs of the hub must be rotationally aligned with the mating recesses of the spindle. The drive hub is normally coupled to the drive shaft by positioning the hub over an end of the spindle until the lugs contact the spindle. The hub is then rotated, sometimes nearly 180°, until the lugs are received in the spindle recesses.

However, conventional drive hubs are not necessarily properly centered on the spindle when the lugs make initial contact. If anything, the lugs position the drive hub in one dimension, i.e., relative to the axis defined by the opposing lugs. The hub and spindle may still be misaligned relative to an axis transverse to the axis of the lugs. Consequently, some difficulty may be experienced in engaging the hub and spindle.

It will be appreciated that visibility and working space are limited when changing or replacing a broom as the hub is normally connected to the broom. Moreover, the equipment is cumbersome and difficult to manipulate. The above noted difficulties in engagement therefore result in considerable annoyance and increase down time for the sweeper.

According to one aspect of the present invention, an improved drive hub is provided which enhances power transmission and facilitates hub/spindle engagement. The drive hub comprises an annular structure with three inwardly projecting lugs for engaging mating recesses of a drive spindle and distributing the shear forces associated with drive torque transmission. The annular structure has an outer portion which is adapted for engaging the cylinder of a cylindrical broom. For example, the annular structure can include an annular groove or flange for engaging the cylinder, an outer wall of the annular structure can be dimensioned to form a friction fit against the inside of the cylinder, or any other suitable engagement structure may be provided.

The lugs project inwardly from an inner surface of the annular structure and are positioned such that the drive hub is self-centering during hub/spindle engagement. In this regard, the lugs are positioned such that a radial axis is defined by a center point of the hub (i.e. coincident with the rotational axis) and the position of a first lug, a second lug is positioned on one side of the radial axis and the third lug is positioned on the other side of the radial axis. Preferably the lugs define a triangle which includes the center point of the hub. In this manner, the lugs ensure proper centering in two dimensions; namely, axially and transversely relative to the radial axis. The lugs are preferably substantially equally spaced about the circumference of the annular structure so that the maximum rotation necessary to achieve lug/recess alignment will be less than about 120°, well within the range of rotations that a typical user can execute without changing grips.

According to another aspect of the present invention, a spindle is provided which further facilitates hub/spindle engagement. The spindle is adapted for mounting on a drive shaft and includes an outer surface having three recesses for matingly engaging the drive hub. The spindle further includes a tapered end portion for receiving the drive hub during hub/spindle engagement such that interaction of the tapered portion with the drive hub lugs as the hug is progressively slided over the spindle serves to center the hub in two dimensions relative to the spindle. Guide surfaces are preferably provided to guide the lugs into the recesses thereby further facilitating engagement.

According to a still further aspect of the present invention, a hub/annular structure interface is provided which is of simple and lightweight construction, provides suitable load bearing characteristics and eliminates hub warping. The interface includes a first portion such as a radial rib extending from one side wall of the lug to an outer wall of the annular structure and a second portion such as another radial rib extending from the other side wall of the lug to the outer wall. The first and second portions are separated by a cavity having a width and depth at least about one-half that of the lug. Preferably the interface structure further includes a central beam having a depth less than the depth of the cavity and extending across the cavity from the lug to the outer wall. The annular structure, lugs and interface structure are preferably of unitary construction and may comprise injection molded plastic.

The described cavity provides a number of advantages. First, the cavity reduces the weight of the hub drive and material requirements while maintaining excellent radial and shear load bearing characteristics. Additionally, the cavity allows the product to set more rapidly during molding thereby increasing throughput and reducing costs. Moreover, the inventors have found that significant warping of hub can occur during manufacturing in the absence of an adequate cavity in the interface structure. Such warping can cause the broom to wobble or bounce and results in increased wear.

BRIEF DESCRIPTION OF THE DRAWINGS

For a more complete understanding of the present invention and further advantages thereof, reference is now made to the following detailed description taken in conjunction with the drawings, in which.

DETAILED DESCRIPTION OF THE PREFERRED EMBODIMENT

Figure 5:
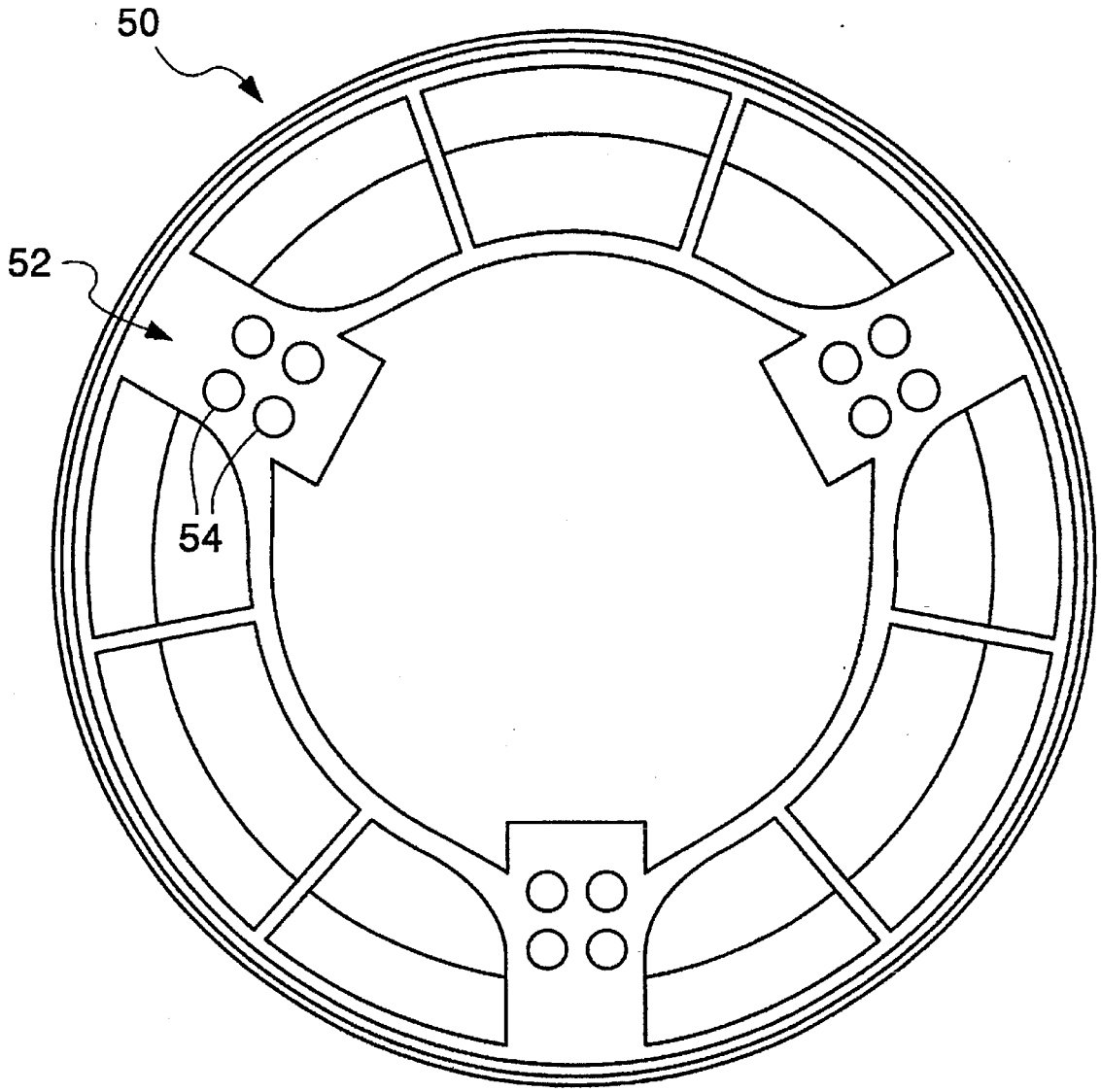
FIG. 5 is an axial view of a drive hub in accordance with an alternative embodiment of the present invention.
Figure 6:
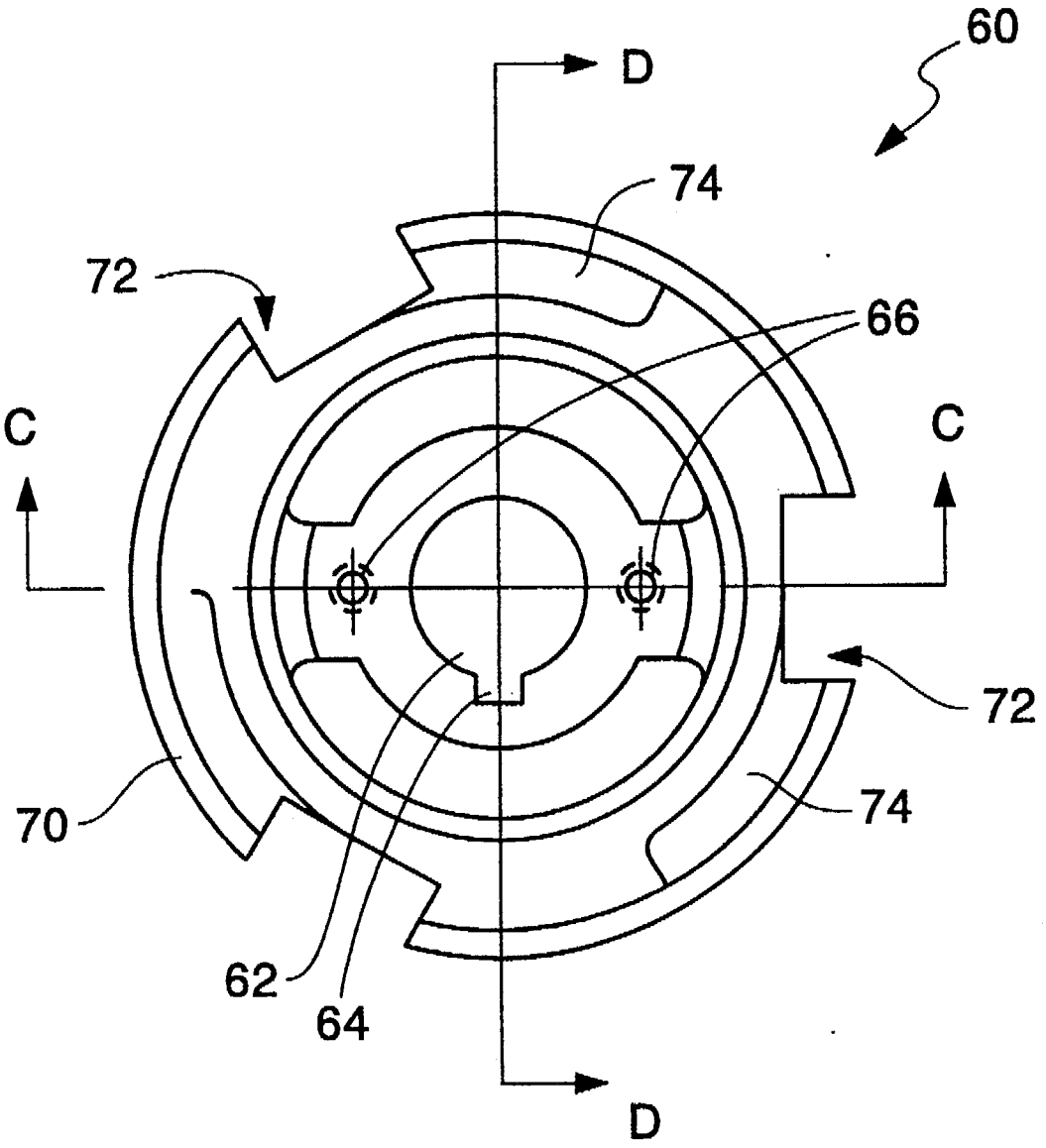
FIG. 6 is an axial view of a spindle constructed in accordance with the present invention.
Figure 7:
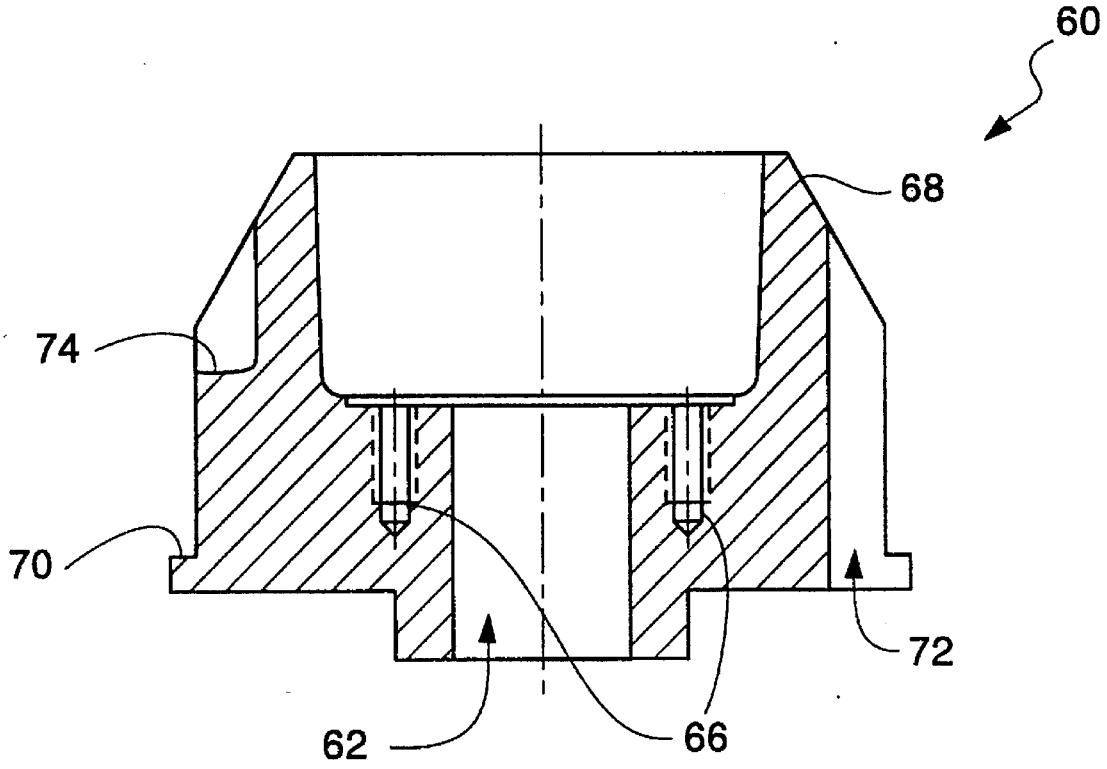
FIG. 7 is a sectional view of the spindle of FIG. 6 relative to section lines C—C.
Figure 8:
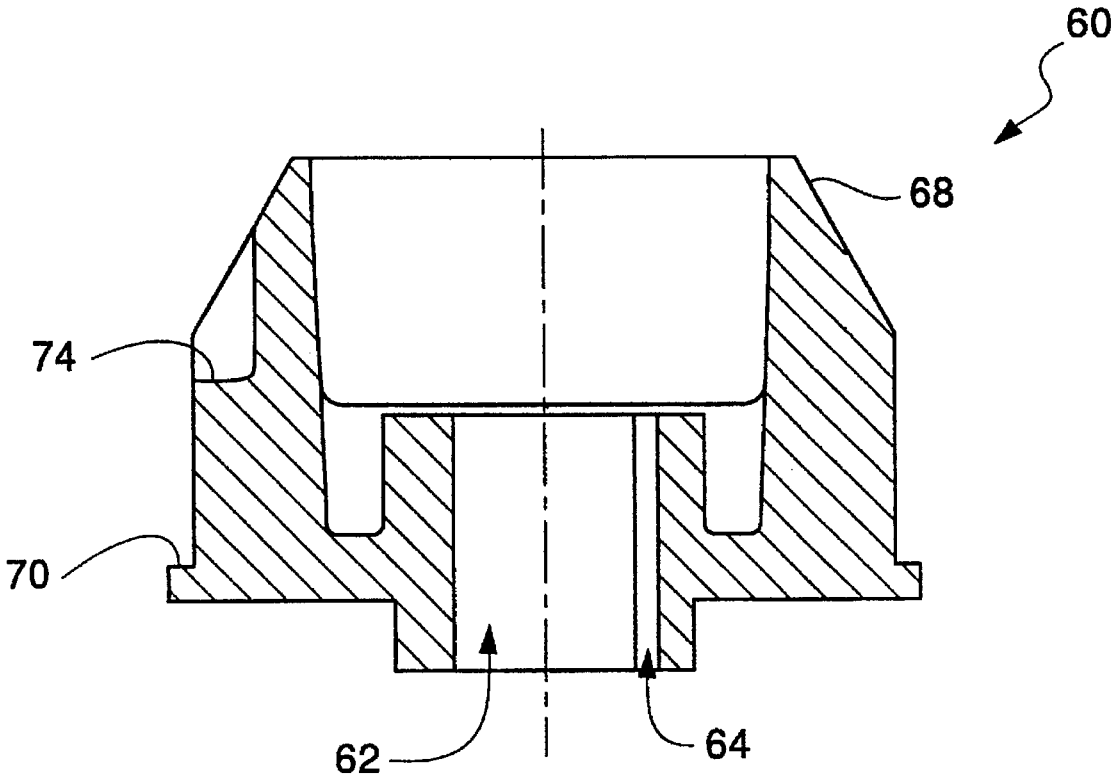
FIG. 8 is a sectional view of the spindle of FIG. 6 relative to section lines D—D.

In the following detailed description, the invention is set forth with respect to a first embodiment of a drive hub according to the present invention (FIG. 1–4), a second embodiment of the drive hub (FIG. 5) and an embodiment of a drive spindle according to the present invention (FIGS. 6–8). Although the invention is thus set forth with respect to specific embodiments, it will be appreciated that various aspects of the invention are more broadly applicable to the field of hub drives and especially to hub drives for brooms of industrial sweepers.

Figure 1:
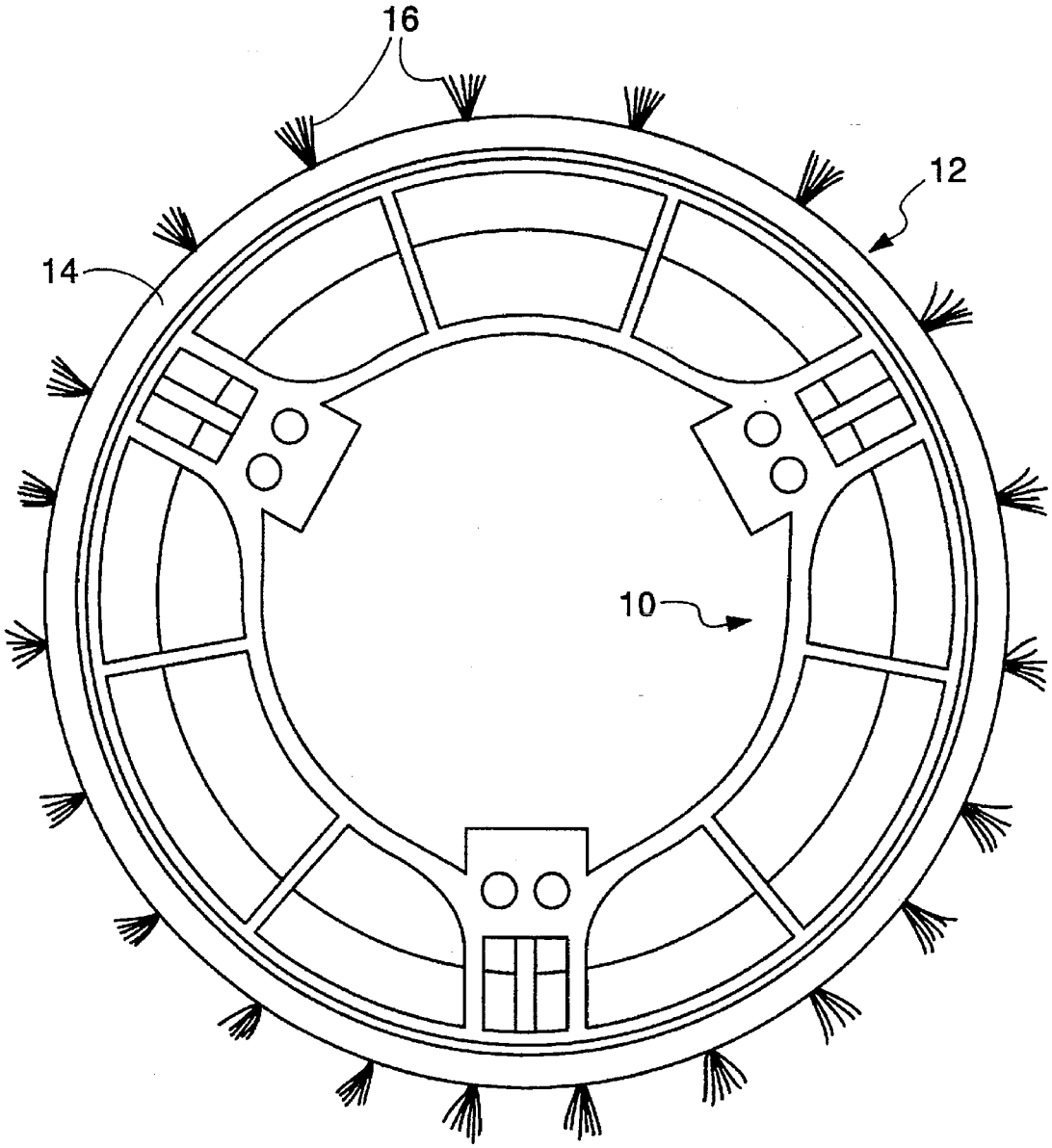
FIG. 1 is an axial view of a broom interconnected to a drive hub in accordance with the present invention.

Referring to FIGS. 1–4, a drive hub for driving a broom 12 of an industrial sweeper is generally identified by the reference numeral 10. As shown in FIG. 1, the drive hub is positioned within the cylinder 14 of the broom 12. Once positioned within the cylinder 14, the drive hub 10 can be secured in place, for example, by way of self-threading screws inserted through the cylinder 14 into the drive hub 10. As shown in FIG. 1, the conventional broom 12 includes a number of brushes 16 which are rotated against a floor surface so as to pull debris from the surface.

Figure 2:
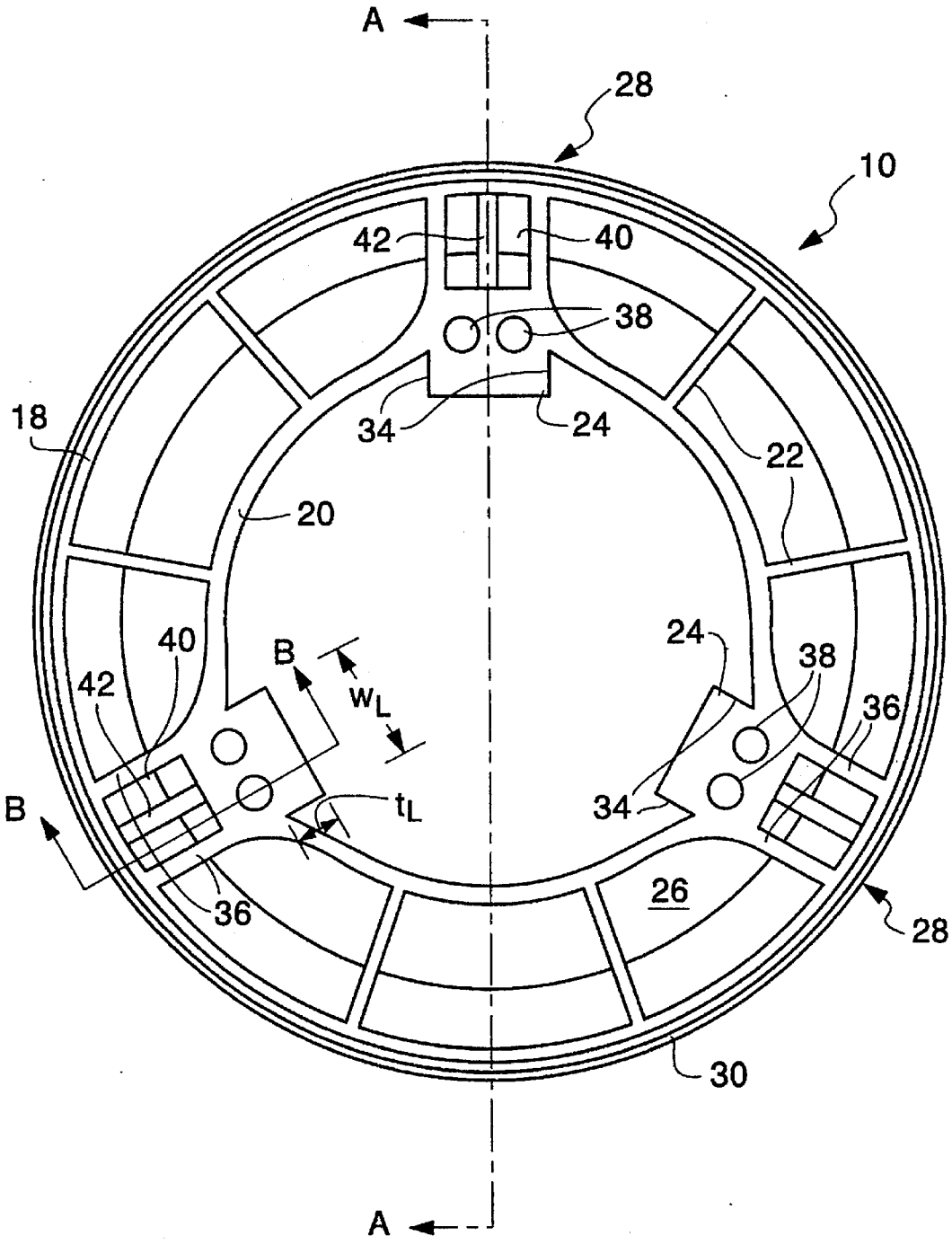
FIG. 2 is a axial view of the drive hub of FIG. 1.
Figure 3:
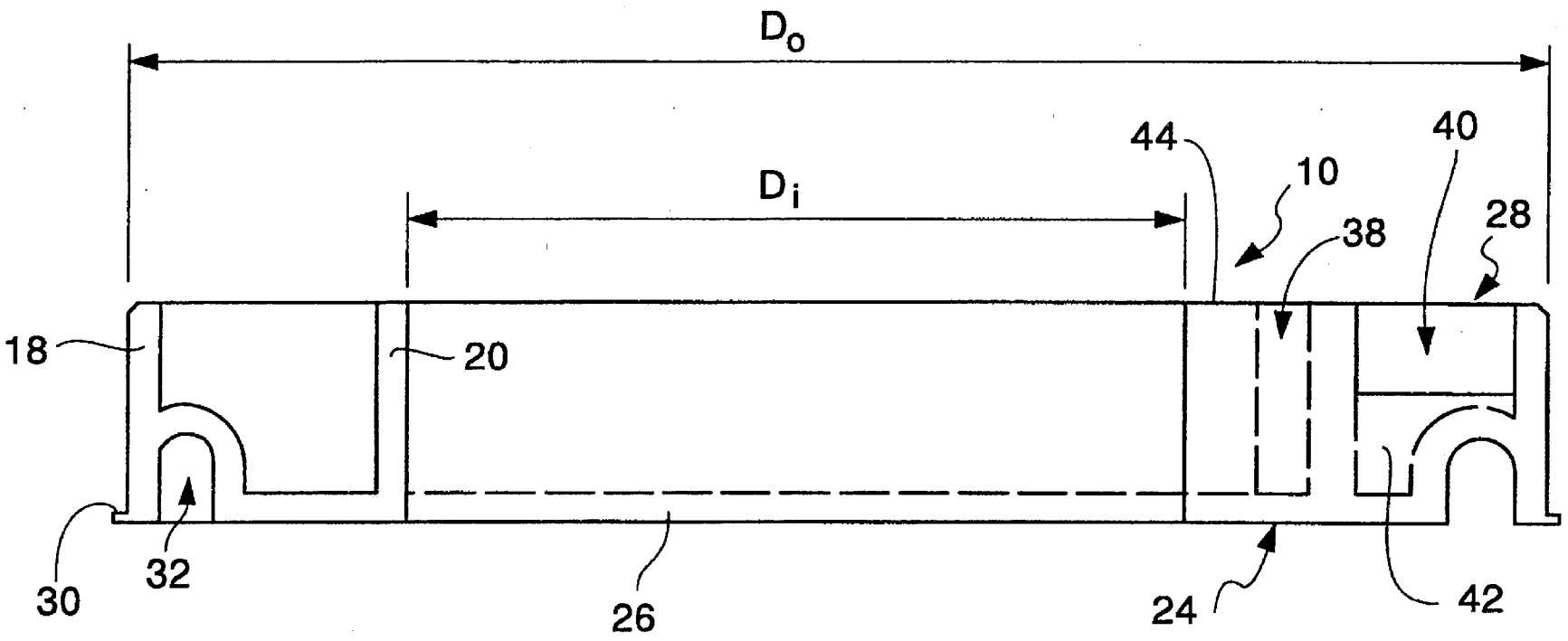
FIG. 3 is a sectional view of the drive hub of FIG. 2 relative to section lines A—A.
Figure 4:
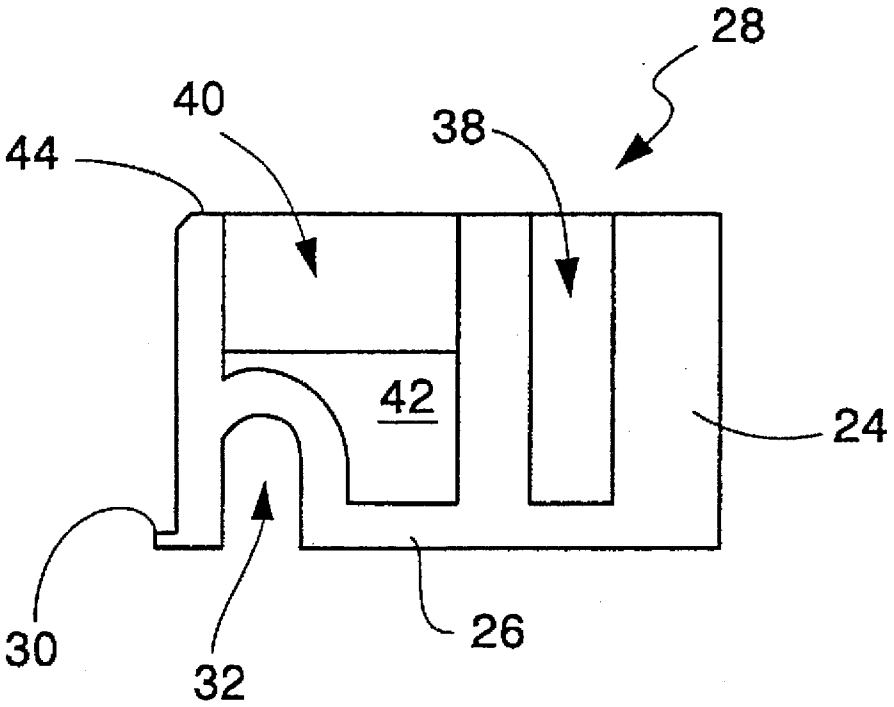
FIG. 4 is a sectional view of the drive hub of FIG. 2 relative to section lines B—B.

Details of the drive hub 10 are shown in FIGS. 2–4. The illustrated drive hub 10 is an integral structure formed from injection molded plastic although other materials or production processes may be utilized. Generally, the drive hub 10 includes an outer rim 18, an inner rim 20, a number of radially oriented reinforcing ribs 22 interconnecting the rims 18 and 20, three solid plastic lugs 24 projecting inwardly from the inner rim 20, a bottom wall 26, and a reinforcing structure 28 for interconnecting each of the lugs 24 to the outer rim 18.

The drive hub 10 has an inside diameter, $D_i$, selected to substantially match the outer diameter of the drive spindle described below, and an outside diameter, $D_o$, selected to substantially match the inside diameter of the cylinder 14 of broom 12. In the latter regard, a flange 30 may define a diameter slightly larger than the inside diameter of the cylinder 14 to ensure a close fit between the drive hub and the cylinder. A molded channel 32 inside of the outer rim 18 provides a degree of flexibility so that the flange 30 can be retracted if necessary as the drive hub 10 is inserted into the cylinder 14. In this manner, a tight fit is achieved between the drive hub and the cylinder 14 without requiring impractical tolerances.

In the illustrated embodiment the inside diameter, $D_i$, is about 10 centimeters and the outside diameter, $D_o$ is approximately 16 centimeters, however, it will be appreciated that these dimensions may be varied depending on the dimensions of the spindle and the cylinder 14. The channel 32 has a depth of approximately 1 centimeter. The illustrated outer rim 18 and inner rim 20 each have a radial thickness of approximately 25 millimeters.

The lugs 24 are dimensioned and positioned so as to mate with corresponding recesses in the spindle as described below. In the illustrated embodiment, the lugs have a circumferential width, $W_L$, as defined by the lug side walls 34 of approximately 22 millimeters. The lugs 24 further have a radial thickness $t_L$, defined by the side walls measured from the inner rim 20, of approximately 8 millimeters. The lugs 24 are spaced so as to provide two-dimensional centering of the hub 10 and, in this regard, the illustrated lugs 24 are substantially equally spaced about the circumference of the inner rim 20, i.e., are spaced about 120° apart. The illustrated lugs have a depth of about 25 millimeters.

The reinforcing structure 28 for each of the lugs 24 includes first and second side walls 36 having an axial depth at least about as great as the depth of the lug 24 and extending generally radially from the outer rim 18 to the inner rim 20; first and second circular openings 38 located adjacent to the lug 24; a large cavity 40 between the side walls 36; and a beam 42 extending radially across the cavity 40 from the outer rim 18. The structure 28 provides the required load bearing characteristics with reduced material and weight. In addition, the structure 28 provides for rapid setting during construction substantially without warping of the drive hub 10. The illustrated openings 38 and cavity 40 each extend axially from a top surface 44 of the drive hub 10 a distance which is at least about half the depth of the drive hub 10 and, in the illustrated embodiment, have a depth of approximately 21 to 22 millimeters.

Cavity 40 has a circumferential width which is at least half the width of the lug 24. In the illustrated embodiment, cavity 40 has a width of approximately 16 millimeters. Cavity 40 further has a radial length of approximately 17 millimeters. The circular openings 38 each have a diameter of approximately 7 millimeters. Beam 42, which is centrally positioned relative to a width of the cavity 40, has an axial depth which is less than the depth of the side walls 36 and, more preferably, less than about one-half the depth of the side walls 36. The illustrated beam 42 extends axially from the bottom wall 26 a distance of approximately 12 millimeters. For improved structural integrity, a fileted corner is provided between each of the side walls 36 and the inner rim 20.

Referring to FIG. 5, an alternative embodiment of the drive hub of the present invention is generally identified by the referenced numeral 50. The drive hub 50 is similar to the drive hub 10 of FIGS. 1–4 except for a different reinforcing structure 52 is employed. As shown in FIG. 5, the reinforcing structure 52 is comprised of a solid plastic mass interrupted by four circular openings 54. Each of the openings 54 has a diameter of approximately 7 millimeters. The reinforcing structure 52 has superior load bearing characteristics but is somewhat heavier than that of the previously described embodiment, and requires somewhat more material.

Referring to FIGS. 6–8, a drive spindle constructed in accordance with an embodiment of the present invention is generally identified by the referenced numeral 60. The spindle 60 interconnects a drive hub as described above to a drive shaft (not shown) such that the drive shaft can be employed to rotationally drive a broom. The spindle 60 receives the drive shaft through central opening 62 and is coupled to the drive shaft by way of keyway 64 and bolts received within threaded holes 66. The drive shaft is driven by a conventional motor.

Spindle 60, which can be formed from cast metal, includes a tapered end 68 for slidably receiving the drive hub, a spindle flange 70 for seating the drive hub, and three recesses 72 for receiving the corresponding lugs of the drive hub. Sloping guide surfaces 74 are provided adjacent to the recesses 72 to assist in guiding the lugs into the recesses during engagement.

Referring to FIGS. 1–4 and 6–8, hub/spindle engagement is accomplished as follows. Initially, the spindle 60 is mounted on the drive shaft and the drive hub 10 is coupled to the broom. Engagement is initiated by lifting the broom 12 and axially moving the broom over the shaft so that the shaft and spindle 60 are received within the cylinder 14 of broom 12. As the broom 12 is moved over the shaft, lugs 24 will pass over the edge of the spindle 60 and the drive hub will eventually reach a position where all three of the lugs 24 contact the tapered end 68 of the spindle. In this position, the drive hub is properly centered in two dimensions.

The drive hub 10 is then rotated counter-clockwise until the lugs 24 are received within the recesses 72. The guide surfaces 74 assist in this regard by permitting axial advancement as the broom is rotated into proper alignment such that inadvertent over-rotation is avoided. It will be appreciated that the maximum rotation required will be no more than about 120°, well within the range of motion which can be executed by most users without changing grips. After the lugs 24 are received within recesses 72, the broom is axially advanced until the drive hub 10 is seated against flange 70. The broom 12 can then be coupled to the shaft in conventional fashion.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A drive hub spindle assembly for use in linking a broom to a rotatable drive so as to transmit power from the drive shaft to the broom, the broom including an internal cylinder defining an opening for axially receiving the drive shaft, said drive hub-spindle assembly comprising:

a spindle adapted for mounting on the drive shaft;

an annular hub structure including an outer portion for engaging the internal cylinder of the broom and an inner surface defining an opening dimensioned for receiving said spindle; and first, second and third lugs extending inwardly from said inner surface of said annular hub structure for engaging mating recesses of said spindle, each of said lugs bearing against one of said recesses of said spindle so that power is transmitted from said spindle to said annular hub structure via said lugs;

said first, second and third lugs being substantially equally spaced relative to a circumference of said annular hub structure, whereby said lugs facilitate engagement of said annular hub structure to the drive shaft via said spindle as well as power transmission;

wherein said spindle has a tapered end portion terminating in a first end, said first end having a first diameter less than a second diameter defined by said lugs, said tapered end portion further including a location having a third diameter substantially equal to said second diameter defined by said lugs, wherein said lugs contact said tapered end portion at said location such that said annular hub structure is substantially centered relative to said spindle.

2. The assembly of claim 1, wherein at least one of said lugs has a circumferential width defined by first and second side surfaces and said annular hub structure comprises an outer wall and reinforcing means for interconnecting said one lug to said outer wall, said reinforcing means including a first portion adjacent to said first side surface of said one lug and radially extending from said one lug to said outer wall, a second portion adjacent to said second side surface of said first lug and radially extending from said first lug to said outer wall, and a cavity, disposed between said first and second portions, having a width that is at least about half the width of said one lug.

3. The assembly of claim 1, wherein at least one of said lugs has a circumferential width defined by first and second side surfaces of said one lug, and said annular hub structure comprises an outer wall, a first rib adjacent to said first side surface and radially extending from said first lug to said outer wall, a second rib, separate from said first rib, adjacent to said second side surface and radially extending from said one lug to said outer wall, and a beam separate from said first and second ribs and disposed therebetween, extending from said first lug to said outer wall, wherein said beam has a axial depth less than the axial depths of said first and second ribs.

4. The assembly of claim 1, further comprising means, disposed between at least one of said lugs and an outer wall of said annular hub structure, for reducing warping of said annular hub structure.

5. The assembly of claim 4, wherein said means for reducing warping comprises a reinforcing structure defining an opening having a width at least half the width of said one lug.

6. The assembly of claim 4, wherein said means for reducing warping comprises a reinforcing structure defining first and second openings having different dimensions.

7. A self-centering drive hub-broom assembly for engaging a rotatable drive means comprising:

a cylindrical broom having a cylindrical bristle carrier and a plurality of bristles attached to said cylindrical bristle carrier, wherein said cylindrical external surface having a first radius relative to said broom axis and extending from a first broom terminal end to a second broom terminal end to define a broom length, a cylindrical internal surface having a second radius relative to said broom axis that is less than said first radius and extending from said first broom terminal end towards said second broom terminal end to form a first circular opening at said first broom terminal end, wherein said plurality of bristles extend in a radial direction from said cylindrical external surface and said broom axis;

a drive hub adapted for interconnection to said broom, wherein said drive hub includes a hub axis, a cylindrical outer surface having a third radius relative to said hub axis that is less than said second radius of said cylindrical internal surface of said cylindrical bristle carrier, said cylindrical outer surface extending from a first hub terminal end to a second hub terminal end to define a hub length that is less than said broom length, said drive hub further including first, second and third lugs for bearing against the rotatable drive means;

wherein said first lug has a radial extent that begins at a first lug outer radial location which is between said cylindrical outer surface and said hub axis and extends inwardly towards said hub axis to end at a first lug inner radial location, wherein said first lug further has a first lug circumferential width, wherein a radial axis extends radially through said hub axis and through said first lug;

wherein said second lug, disposed on a first side of said radial axis and at a first-second lug distance from said first lug, has a radial extent that begins at a second lug outer radial location which is between said cylindrical outer surface and said hub axis and extends inwardly towards said hub axis to end at a second lug inner radial location, wherein said second lug further has a second lug circumferential width that is substantially equal to said first lug circumferential width; and wherein said third lug, disposed on a second side of said radial axis and at a first-third lug distance from said first lug and a second-third lug distance from said second lug that is substantially equal to both said first-second lug distance and said first-third lug distance, has a third lug radial extent that begins at a third lug outer radial location which is between said cylindrical outer surface and said hub axis and extends inwardly towards said hub axis to end at a third lug inner radial location, wherein said third lug further has a third lug circumferential width that is substantially equal to said second lug circumferential width;

wherein said first lug, second lug and third lug inner radial locations are substantially equidistantly spaced from said hub axis and define a cylindrically-shaped spindle interface for contacting at least a portion of the spindle associated with the rotatable drive means;

wherein said first, second and third lugs facilitate engagement of said broom and the rotatable drive means;

wherein said drive hub is entirely located within said cylindrical internal surface of said cylindrical bristle carrier, further located so that said broom axis is substantially coincident with said hub axis, further located so that said cylindrical external surface and cylindrical internal surface of said cylindrical bristle carrier are substantially concentric with said cylindrical outer surface of said drive hub, and further located so that the rotatable drive means can engage said drive hub through said circular opening of said cylindrical bristle carrier;

means, radially extending between said cylindrical outer surface of said drive hub and said cylindrical internal surface of said cylindrical bristle carrier, for connecting said broom and said drive hub.

8. The drive hub-broom assembly of claim 7, wherein said first lug has a circumferential width defined by first and second side surfaces and said drive hub comprises an outer wall and reinforcing means for interconnecting said first lug to said outer wall, said reinforcing means including a first portion adjacent to said first side surface of said first lug and radially extending from said first lug to said outer wall, a second portion adjacent to said second side surface of said first lug and radially extending from said first lug to said outer wall, and a cavity, disposed between said first and second portions, having a width that is at least about half the width of said first lug.

9. The drive hub-broom assembly of claim 7, wherein said first lug has a circumferential width defined by first and second side surfaces of said first lug, and said drive hub comprises an outer wall, a first rib adjacent to said first side surface and radially extending from said first lug to said outer wall, a second rib, separate from said first rib, adjacent to said second side surface and radially extending from said first lug to said outer wall, and a beam separate from said first and second ribs and disposed therebetween, extending from said first lug to said outer wall, wherein said beam has an axial depth less than that of said first and second ribs.

10. The drive hub-broom assembly of claim 7, further comprising means, disposed between at least one of said lugs and an outer wall of said drive hub, for reducing warping of said drive hub.

11. The drive hub-broom assembly of claim 10, wherein said means for reducing warping comprises a reinforcing structure defining an opening having a width at least half the width of said one lug.

12. The drive hub-broom assembly of claim 10, wherein said means for reducing warping comprises a reinforcing structure defining first and second openings having different dimensions.

13. The drive hub-broom assembly of claim 7 further comprising:

a second drive hub that is substantially identical to said drive hub and located substantially as said drive hub within said cylindrical internal surface of said cylindrical bristle carrier but closer to said second broom terminal end than said drive hub.

* * * * *